US006180561B1

(12) United States Patent
Chapman et al.

(10) Patent No.: US 6,180,561 B1
(45) Date of Patent: Jan. 30, 2001

(54) COMPLEXING AGENT FOR THERMAL COLOR PROOFING

(75) Inventors: Derek D. Chapman; Richard C. Vanhanehem, both of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/328,720

(22) Filed: Jun. 9, 1999

(51) Int. Cl.[7] ..... B41M 5/035; B41M 5/38

(52) U.S. Cl. ..... 503/227; 438/913; 438/914

(58) Field of Search ..... 8/471; 428/195, 428/913, 914; 503/227

(56) References Cited

U.S. PATENT DOCUMENTS 5,866,509 2/1999 Chapman et al. ..... 503/227

*Primary Examiner*—Bruce H. Hess
(74) *Attorney, Agent, or Firm*—Harold E. Cole

(57) ABSTRACT

A magenta dye-donor element for thermal dye transfer comprising a support having thereon a dye layer comprising a mixture of magenta dyes and a yellow dye dispersed in a polymeric binder, at least one of the magenta dyes having the formula:

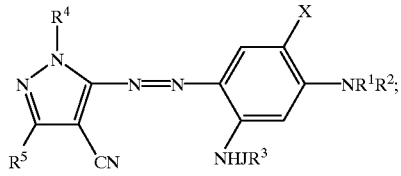

at least another of the magenta dyes having the formula:

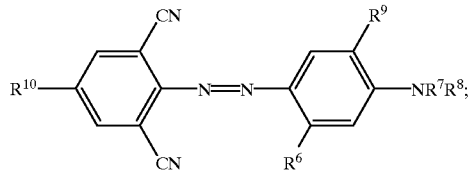

said yellow dye having the formula:

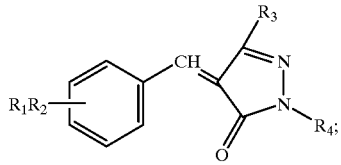

and said element contains a complexing agent having the formula:

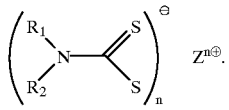

15 Claims, No Drawings

COMPLEXING AGENT FOR THERMAL COLOR PROOFING

CROSS REFERENCE TO RELATED APPLICATIONS

Reference is made to commonly-assigned copending U.S. patent application Ser. No. 09/327,845, pending, filed Jun. 8, 1999, entitled "Complexing Agent for Thermal Color Proofing", of Chapman et al.; and U.S. patent application Ser. No. 09/329,161, pending, filed of even date herewith, entitled "Complexing Agent for Thermal Color Proofing", of Chapman et al.; the teachings of which are incorporated herein by reference.

FIELD OF THE INVENTION

This invention relates to use of a complexing agent in a mixture of dyes in a magenta dye-donor element for thermal dye transfer imaging which is used to obtain a color proof that accurately represents the hue of a printed color image obtained from a printing press.

BACKGROUND OF THE INVENTION

In order to approximate the appearance of continuous-tone (photographic) images via ink-on-paper printing, the commercial printing industry relies on a process known as halftone printing. In halftone printing, color density gradations are produced by printing patterns of dots or areas of varying sizes, but of the same color density, instead of varying the color density continuously as is done in photographic printing.

There is an important commercial need to obtain a color proof image before a printing press run is made. It is desired that the color proof will accurately represent at least the details and color tone scale of the prints obtained on the printing press. In many cases, it is also desirable that the color proof accurately represent the image quality and halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled.

Colorants that are used in the printing industry are insoluble pigments. By virtue of their pigment character, the spectrophotometric curves of the printing inks are often unusually sharp on either the bathochromic or hypsochromic side. This can cause problems in color proofing systems in which dyes, as opposed to pigments, are being used. It is very difficult to match the hue of a given ink using a single dye.

In U.S. Pat. No. 5,126,760, a process is described for producing a direct digital, halftone color proof of an original image on a dye-receiving element. The proof can then be used to represent a printed color image obtained from a printing press. The process described therein comprises:

a) generating a set of electrical signals which is representative of the shape and color scale of an original image;

b) contacting a dye-donor element comprising a support having thereon a dye layer and an infrared-absorbing material with a first dye-receiving element comprising a support having thereon a polymeric, dye image-receiving layer;

c) using the signals to imagewise-heat by means of a diode laser the dye-donor element, thereby transferring a dye image to the first dye-receiving element; and d) retransferring the dye image to a second dye image-receiving element which has the same substrate as the printed color image.

In the above process, multiple dye-donors are used to obtain a complete range of colors in the proof. For example, for a full-color proof, four colors: cyan, magenta, yellow and black are normally used.

By using the above process, the image dye is transferred by heating the dye-donor containing the infrared-absorbing material with the diode laser to volatilize the dye, the diode laser beam being modulated by the set of signals which is representative of the shape and color of the original image, so that the dye is heated to cause volatilization only in those areas in which its presence is required on the dye-receiving layer to reconstruct the original image.

Similarly, a thermal transfer proof can be generated by using a thermal head in place of a diode laser as described in U.S. Pat. No. 4,923,846. Commonly available thermal heads are not capable of generating halftone images of adequate resolution but can produce high quality continuous tone proof images which are satisfactory in many instances. U.S. Pat. No. 4,923,846 also discloses the choice of mixtures of dyes for use in thermal imaging proofing systems. The dyes are selected on the basis of values for hue error and turbidity. The Graphic Arts Technical Foundation Research Report No. 38, "Color Material" (58-(5) 293–301, 1985) gives an account of this method.

An alternative and more precise method for color measurement and analysis uses the concept of uniform color space known as CIELAB in which a sample is analyzed mathematically in terms of its spectrophotometric curve, the nature of the illuminant under which it is viewed and the color vision of a standard observer. For a discussion of CIELAB and color measurement, see *Principles of Color Technology,* 2nd Edition, F. W. Billmeyer, p. 25–110, Wiley-Interscience and *Optical Radiation Measurements*, Volume 2, F. Grum, p. 33–145, Academic Press.

In using CIELAB, colors can be expressed in terms of three parameters: L*, a* and b*, where L* is a lightness function, and a* and b* define a point in color space. Thus, a plot of a* vs b* values for a color sample can be used to accurately show where that sample lies in color space, i.e., what its hue is. This allows different samples to be compared for hue if they have similar density and L* values.

In color proofing in the printing industry, it is important to be able to match the proofing ink references provided by the International Prepress Proofing Association. These ink references are density patches made with standard 4-color process inks and are known as SWOP® (Specifications Web Offset Publications) color aims. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, p. 55.

The magenta SWOP color aim is actually slightly reddish since it contains a high amount of blue absorption. Therefore, a "good" magenta dye selected from a photographic standpoint would not be suitable for matching the magenta SWOP color aim.

DESCRIPTION OF RELATED ART

In U.S. Pat. No. 5,866,509, a magenta dye donor element comprising a mixture of magenta dyes and a yellow dye is described for color proofing. However, a problem has developed using the dye solutions when it is necessary to hold them for a period of time before coating in that the composition of the solutions changes. Thus when a comparison of coatings was made from the fresh solution and the aged solution, the donor made from the aged solution did not deliver the correct colorimetry. Analysis of the aged solution showed that the change in composition was caused by decomposition of the yellow dye which is due to the presence of copper ion in one of the magenta dyes. Cuprous cyanide is used in the synthesis of one of the magenta dyes and it is difficult to remove all traces of copper from the final dye.

It is an object of this invention to provide a magenta dye donor element comprising a mixture of magenta dyes and a yellow dye for color proofing which is stable over a period of time.

SUMMARY OF THE INVENTION

These and other objects are obtained by this invention which relates to a magenta dye-donor element for thermal dye transfer comprising a support having thereon a dye layer comprising a mixture of magenta dyes and a yellow dye dispersed in a polymeric binder, at least one of the magenta dyes having the formula:

I

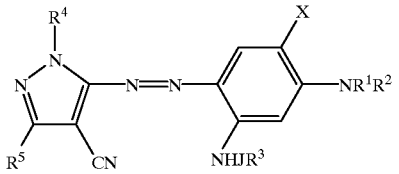

wherein:

$R^1$ is a substituted or unsubstituted alkyl or allyl group of from 1 to about 6 carbon atoms, such as methyl, ethyl, propyl, isopropyl, butyl, pentyl, allyl, but-2-en-1-yl, 1,1-dichloropropen-3-yl, or such alkyl or allyl groups substituted with hydroxy, acyloxy, alkoxy, aryl, cyano, acylamido, halogen, etc.;

X is an alkoxy group of from 1 to about 4 carbon atoms or represents the atoms which when taken together with $R^2$ forms a 5- or 6-membered ring;

$R^2$ is any of the groups for $R^1$ or represents the atoms which when taken together with X forms a 5- or 6-membered ring;

$R^3$ is a substituted or unsubstituted alkyl group of from 1 to about 6 carbon atoms such as those listed above for $R^1$, or a substituted or unsubstituted aryl group of from about 6 to about 10 carbon atoms such as phenyl, naphthyl, p-tolyl, m-chlorophenyl, p-methoxyphenyl, m-bromophenyl, o-tolyl, etc.;

J is CO, $CO_2$, —$SO_2$— or $CONR^5$—;

$R^4$ is a substituted or unsubstituted alkyl or allyl group of from 1 to about 6 carbon atoms, such as those listed above for $R^1$, or a substituted or unsubstituted aryl group of from about 6 to about 10 carbon atoms, such as those listed above for $R^3$; and $R^5$ is hydrogen, a substituted or unsubstituted alkyl group of from 1 to about 6 carbon atoms, such as those listed above for $R^1$, or a substituted or unsubstituted aryl group of from about 6 to about 10 carbon atoms, such as those listed above for $R^3$;

at least another of the magenta dyes having the formula:

II

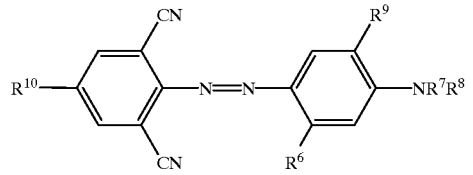

wherein:

$R^6$ is a substituted or unsubstituted alkyl group having from 1 to about 4 carbon atoms, an alkoxy group having from 1 to about 4 carbon atoms, an alkylcarbonamido group having from 1 to about 6 carbon atoms or an alkylsulfonamido group having from 1 to about 8 carbon atoms;

$R^7$ and $R^8$ each individually represent a substituted or unsubstituted aryl group having from about 6 to about 10 carbon atoms, a substituted or unsubstituted alkyl group having from 1 to about 5 carbon atoms, an alkoxyalkyl group having from 3 to about 8 carbon atoms, an aralkyl group having from about 7 to about 10 carbon atoms or a hydroxyalkyl group having from about 2 to about 5 carbon atoms;

$R^9$ is hydrogen, halogen, an alkoxy group having from 1 to about 4 carbon atoms or may be taken together with $R^7$ or $R^8$ to form a 5- or 6-membered heterocyclic ring; and $R^{10}$ is hydrogen, a substituted or unsubstituted alkyl group having from 1 to about 8 carbon atoms or an alkoxy group having from 1 to about 4 carbon atoms; and the yellow dye having the following formula:

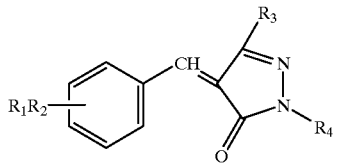

wherein:

$R_1$, $R_2$ and $R_3$ each individually represents hydrogen or a substituted or unsubstituted alkyl or alkoxy group having from 1 to about 4 carbon atoms; and $R_4$ represents a substituted or unsubstituted aryl group having from 6 to about 10 carbon atoms or a substituted or unsubstituted alkyl group having from 1 to about 4 carbon atoms;

and the element contains a complexing agent having the formula:

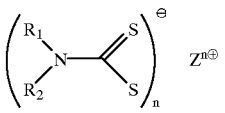

wherein $R_1$ and $R_2$ each independently represents an alkyl group having from 1 to about 6 carbon atoms, such as methyl, ethyl, propyl, etc.; a substituted or unsubstituted aryl group having from 6 to about 10 carbon atoms such as phenyl, naphthyl, p-tolyl, m-chlorophenyl, p-methoxyphenyl, m-bromophenyl, o-tolyl, etc.; or a hetaryl group having from about 5 to about 10 atoms, such as thienyl, furyl, etc.; or $R_1$ and $R_2$ may be taken together to form a 5- or 6-membered ring, such as piperidine, morpholine, pyrrolidine, etc.;

Z represents a cation, such as sodium, zinc, potassium, tetramethylammonium, pyridinium, etc.; and n represents 1 or 2.

DETAILED DESCRIPTION OF THE INVENTION

In a preferred embodiment of the invention, $R_1$ and $R_2$ are taken together to form a piperidine ring, n is 1 and Z is sodium. In still another preferred embodiment, $R_1$ and $R_2$ are each butyl, n is 2 and Z is zinc.

Specific examples of complexing agents useful in the invention include the following:

1

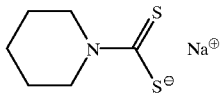

2

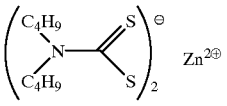

3

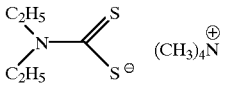

-continued

4

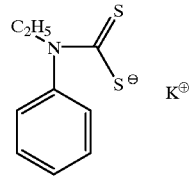

5

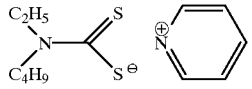

In accordance with the invention, magenta dyes can be used which may have copper impurities and no special purification is necessary. The small amount of complexing agent added to the coating solution has no deleterious effect on the coating solution. In general, the complexing agents may be used at a concentration of from about 0.1 to about 1% in the coating solution, which is equivalent to about 2 to about 20% by weight in the dry coating.

In a preferred embodiment of the invention, $R^1$ and $R^2$ in the above formula I are each ethyl, X is $OCH_3$, J is CO, $R^3$ and $R^4$ are each $CH_3$, and $R^5$ is $C_4H_9$-t. In another preferred embodiment of the invention, $R^1$ and $R^2$ are each ethyl, X is $OCH_3$, J is CO, $R^3$ is $CH_3$, $R^4$ is $CH_2CHOHCH_3$, and $R^5$ is $C_4H_9$-t.

The compounds of the above formula I employed in the invention may be prepared by any of the processes disclosed in U.S. Pat. No. 3,336,285, Br 1,566,985, DE 2,600,036 and Dyes and Pigments, Vol 3, 81 (1982), the disclosures of which are hereby incorporated by reference.

Magenta dyes included within the scope of the above formula I include the following:

I

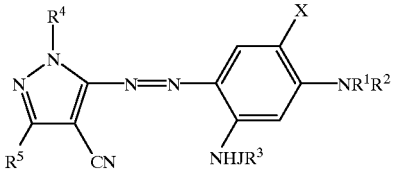

| Dye | $R^1$ | $R^2$ | $R^3$ | $R^4$ | $R^5$ | X | J |
|---|---|---|---|---|---|---|---|
| 1 | $C_2H_5$ | $C_2H_5$ | $CH_3$ | $CH_3$ | $C_4H_9$-t | $OCH_3$ | CO |
| 2 | $C_2H_5$ | $C_2H_5$ | $CH_3$ | $CH_2CH—OHCH_3$ | $C_4H_9$-t | $OCH_3$ | CO |
| 3 | $C_2H_5$ | $C_2H_5$ | $CH_3$ | $CH_2CH—OHC_6H_5$ | $C_4H_9$-t | $OCH_3$ | CO |
| 4 | $C_2H_5$ | $C_2H_5$ | $C_4H_9$-t | $CH_3$ | $CH_3$ | $OCH_3$ | CO |
| 5 | $C_2H_5$ | $C_2H_5$ | $CH_3$ | $C_2H_5$ | $C_4H_9$-t | $OC_2H_5$ | $SO_2$ |

-continued

I

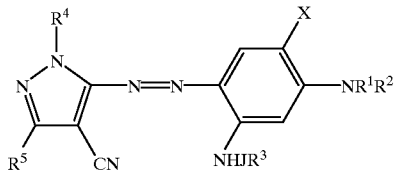

| Dye | $R^1$ | $R^2$ | $R^3$ | $R^4$ | $R^5$ | X | J |
|---|---|---|---|---|---|---|---|
| 6 | $C_2H_5$ | $C_2H_5$ | $C_2H_5$ | $CH_3$ | $CH_3$ | $OC_2H_5$ | CO |
| 7 | $C_2H_5$ | $C_3H_7$ | $CH_3$ | $CH_3$ | $C_4H_9$-t | $OCH_3$ | CO |
| 8 | $C_2H_5$ | $C_2H_5$ | $CH_3$ | $CH_3$ | $C_4H_9$-t | $OCH_3$ | $CO_2$ |
| 9 | $C_2H_5$ | $C_2H_5$ | $C_6H_5$ | $C_3H_7$ | $C_4H_9$-t | $OC_2H_5$ | $SO_2$ |
| 10 | $CH_2{=}CH{-}CH_2$ | $CH_2{=}CH{-}CH_2$ | $CH_3$ | $CH_2C_6H_5$ | $C_4H_9$-t | $OCH_3$ | CO |
| 11 | $C_3H_7$ | $C_3H_7$ | $C_2H_5$ | $C_2H_5$ | $CH_3$ | $OC_3H_7$ | CO |
| 12 | $C_3H_7$ | $C_3H_7$ | $C_2H_5$ | $C_2H_5$ | $CH_3$ | $OC_3H_7$ | $SO_2$ |

13

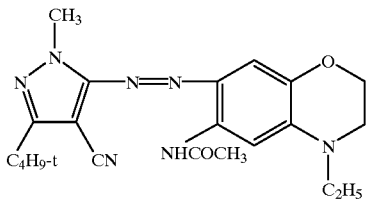

14

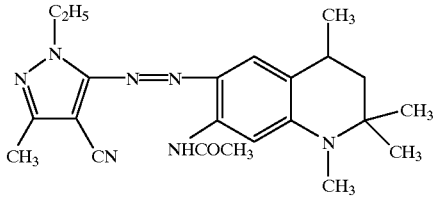

In another preferred embodiment of the invention, $R^6$ in the above formula II is $NHCOCH_3$, $NHSO_2CH_3$ or $CH_3$ and $R^7$ is $C_2H_5$, $C_3H_7$ or $CH_2CH_2OH$. In still another preferred embodiment of the invention, $R^8$ in the above formula II is $C_2H_5$ or $C_3H_7$ and $R^{10}$ is $CH_3$ or $OCH_3$.

The compounds in the above formula II employed in the invention are more fully disclosed along with their preparation in U.S. Pat. No. 5,234,887, the disclosure of which is hereby incorporated by reference.

Magenta dyes included within the scope of the above formula II include the following:

II

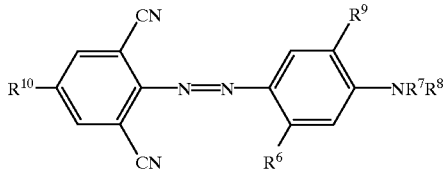

| Compound No | $R^6$ | $R^7$ | $R^8$ | $R^9$ | $R^{10}$ |
|---|---|---|---|---|---|
| A | $NHCOCH_3$ | $C_2H_5$ | $C_2H_5$ | H | $CH_3$ |
| B | $NHSO_2CH_3$ | $C_2H_5$ | $C_3H_7$ | H | $OCH_3$ |
| C | $CH_3$ | $C_2H_5$ | $C_3H_7$ | H | $OCH_3$ |

-continued

II

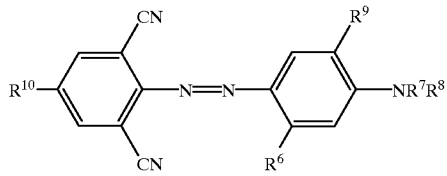

| Compound No | $R^6$ | $R^7$ | $R^8$ | $R^9$ | $R^{10}$ |
|---|---|---|---|---|---|
| D | $NHSO_2CH_3$ | $C_3H_7$ | $C_3H_7$ | H | $CH_3$ |
| E | $NHSO_2CH_3$ | $C_2H_5$ | $C_2H_5$ | H | $CH_3$ |
| F | $NHCOCH_3$ | $CH_2CH_2OH$ | $C_3H_7$ | H | $OCH_3$ |

As noted above, a yellow dye is included with the magenta dye mixture in order to increase the amount of blue absorption and to adjust the colorimetry to match the magenta SWOP color aim. Useful yellow dyes which can be used in accordance with the invention have the following structures:

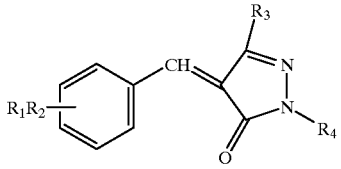

| Compound No. | $R_1$ | $R_2$ | $R_3$ | $R_4$ |
|---|---|---|---|---|
| Y1 | 3-$CH_3O$ | 4-$CH_3O$ | $CH_3$ | $C_6H_5$ |
| Y2 | 3-$CH_3O$ | H | $CH_3$ | $C_6H_5$ |
| Y3 | H | 4-$CH_3O$ | $CH_3$ | $C_6H_5$ |
| Y4 | 3-$CH_3$ | 4-$CH_3O$ | $CH_3$ | $C_6H_5$ |
| Y5 | 3-$CH_3$ | 4-$CH_3$ | $CH_3$ | $C_6H_5$ |
| Y6 | 3-$CH_3$ | 4-$CH_3$ | $CH_3O$ | $CH_3$ |
| Y7 | 3-$CH_3$ | 4-$CH_3$ | $CH_3O$ | $C_6H_5$ |
| Y8 | H | 4-$CH_3O$ | $CH_3O$ | $C_2H_5$ |

The use of dye mixtures in the dye-donor of the invention permits a wide selection of hue and color that enables a closer hue match to a variety of printing inks to be achieved and also permits easy transfer of images to a receiver one or more times if desired. The use of dyes also allows easy modification of image density to any desired level. The dyes of the dye-donor element of the invention may be used at a coverage of from about 0.02 to about 1 g/$m^2$.

The dyes in the dye-donor of the invention are dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; poly(vinyl acetate); poly (styrene-co-acrylonitrile); a polysulfone or a poly(phenylene oxide). The binder may be used at a coverage of from about 0.1 to about 5 g/$m^2$.

The dye layer of the dye-donor element may be coated on the support or printed thereon by a printing technique such as a gravure process.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as poly (vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 $\mu$m. It may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U. S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/$m^2$. If a polymeric binder is employed, the lubricating material is present in the range of 0.1 to 50 weight %, preferably 0.5 to 40%, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The dye image-receiving layer may comprise, for example, a polycarbonate, a polyurethane, a polyester, poly (vinyl chloride), poly(styrene-co-acrylonitrile), polycaprolactone, a poly(vinyl acetal) such as poly(vinyl alcohol-co-butyral), poly(vinyl alcohol-co-benzal), poly (vinyl alcohol-co-acetal) or mixtures thereof. The dye image-receiving layer may be present in any amount which is effective for the intended purpose. In general, good results have been obtained at a concentration of from about 1 to about 5 g/$m^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dyes thereon as described above or may have alternating areas of other different dyes or combinations, such as sublimable cyan and/or yellow and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an absorbing material which absorbs at the emitting wavelength of the laser. When an infrared laser is employed, then an infrared-absorbing material may be used, such as carbon black, cyanine infrared-absorbing dyes as described in U.S. Pat. No. 4,973,572, or other materials as described in the following U.S. Patents: Nos.

4,948,777; 4,950,640; 4,950,639; 4,948,776; 4,948,778; 4,942,141; 4,952,552; 5,036,040; and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in U.S. Pat. No. 5,268,708, the disclosure of which is hereby incorporated by reference.

Spacer beads may be employed in a separate layer over the dye layer of the dye-donor in the above-described laser process in order to separate the dye-donor from the dye-receiver during dye transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the dye-receiver as described in U.S. Pat. No. 4,876,235, the disclosure of which is hereby incorporated by reference. The spacer beads may be coated with a polymeric binder if desired.

The use of an intermediate receiver with subsequent retransfer to a second receiving element may also be employed in the invention. A multitude of different substrates can be used to prepare the color proof (the second receiver) which is preferably the same substrate as that used for the printing press run. Thus, this one intermediate receiver can be optimized for efficient dye uptake without dye-smearing or crystallization.

Examples of substrates which may be used for the second receiving element (color proof) include the following: Flo Kote Cover® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Consolith Gloss® (Consolidated Papers Co.), Ad-Proof Paper® (Appleton Papers, Inc.) and Mountie Matte® (Potlatch Inc.).

As noted above, after the dye image is obtained on a first dye-receiving element, it may be retransferred to a second dye image-receiving element. This can be accomplished, for example, by passing the two receivers between a pair of heated rollers. Other methods of retransferring the dye image could also be used such as using a heated platen, use of pressure and heat, external heating, etc.

Also as noted above, in making a color proof, a set of electrical signals is generated which is representative of the shape and color of an original image. This can be done, for example, by scanning an original image, filtering the image to separate it into the desired additive primary colors, i.e., red, blue and green, and then converting the light energy into electrical energy. The electrical signals are then modified by computer to form the color separation data which are used to form a halftone color proof. Instead of scanning an original object to obtain the electrical signals, the signals may also be generated by computer. This process is described more fully in *Graphic Arts Manual*, Janet Field ed., Arno Press, New York 1980 (p. 358ff), the disclosure of which is hereby incorporated by reference.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLES

Example 1

A solution of magenta and yellow dyes was prepared by adding 1.322 g of the above magenta dye D and 0.404 g of the above yellow dye Y1 to a 70/30 v/v mixture of methyl isobutyl ketone and ethanol and making up to 150 g. The solution was divided into 12 g portions and one was used as a control. To the others at least 5 mg of a complexing agent was added. This quantity ensured that at least twice the amount of complexing agent necessary to form a 2:1 complex with the maximum amount of analyzed copper in the magenta dye was present. The visible spectrum of a diluted aliquot of each solution was measured and recorded. The samples were kept in sealed vials for 5 days at room temperature and then reanalyzed spectrophotometrically.

The results are expressed in Table 1 as a ratio of the absorption at 522 nm, the absorption of the magenta dye, to that at 387 nm, the absorption mostly due to the yellow dye. If the yellow dye decomposes, then the ratio increases from the starting ratio.

For comparison purposes, a sample of the magenta dye D was rigorously purified by several recrystallizations from mixtures of acetylacetone and dimethyl formamide and the stability of a solution in the presence of the yellow dye Y1 measured. The following results were obtained:

TABLE 1

| | Ratio of $D_{522}/D_{387}$ | |
|---|---|---|
| Complexing Agent | Initially | After 5 Days |
| None (Control) | 3.1 | 11.2 |
| 1 | 3.1 | 3.2 |
| 2 | 3.1 | 3.2 |
| None (Control)* | 3.1 | 3.3 |

*Purified magenta dye

The above results show that when a complexing agent is used in accordance with the invention, the yellow dye is substantially still present, in comparison to the control where most of the yellow dye has decomposed. The results obtained in accordance with the invention are comparable to the control where the dye was rigorously purified.

Example 2

A solution was prepared in a similar manner to Example 1 with addition of 0.417 g of cyanine infrared-absorbing dye disclosed in U.S. Pat. No. 5,024,990, column 13, lines 1–15.

As before, the solution was divided into 12 g portions and one was used as a control. To the others was added at least 5 mg of complexing agent and the spectra of the solutions measured. The solutions were kept in sealed vials and examined again after 2 days. The results are expressed in the table as a ratio of the absorption at 522 nm, the absorption of the magenta dye, to that at 820 nm, the absorption of the infrared dye. If the infrared dye decomposes, then the ratio increases from the starting ratio. The following results were obtained:

TABLE 2

| Complexing Agent | Ratio of $D_{522}/D_{820}$ Initially | After 2 Days |
|---|---|---|
| None (Control) | 1.1 | 63 |
| 1 | 1.1 | 1.2 |
| 2 | 1.1 | 1.2 |

The above results show that the infrared dye is almost completely destroyed after 2 days (high ratio), while the solutions used in the invention which contained a complexing agent retained most of the infrared-absorbing dye (modest increase in ratio).

The invention has been described in detail with particular reference to preferred embodiments thereof, but it will be understood that variations and modifications can be effected within the spirit and scope of the invention.

What is claimed is:

1. A magenta dye-donor element for thermal dye transfer comprising a support having thereon a dye layer comprising a mixture of magenta dyes and a yellow dye dispersed in a polymeric binder, at least one of the magenta dyes having the formula:

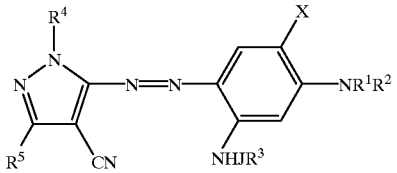

wherein:

$R^1$ is a substituted or unsubstituted alkyl or allyl group of from 1 to about 6 carbon atoms;

X is an alkoxy group of from 1 to about 4 carbon atoms or represents the atoms which when taken together with $R^2$ forms a 5- or 6-membered ring;

$R^2$ is any of the groups for $R^1$ or represents the atoms which when taken together with X forms a 5- or 6-membered ring;

$R^3$ is a substituted or unsubstituted alkyl group of from 1 to about 6 carbon atoms or a substituted or unsubstituted aryl group of from about 6 to about 10 carbon atoms;

J is CO, $CO_2$, —$SO_2$— or $CONR^5$—;

$R^4$ is a substituted or unsubstituted alkyl or allyl group of from 1 to about 6 carbon atoms or a substituted or unsubstituted aryl group of from about 6 to about 10 carbon atoms; and $R^5$ is hydrogen, a substituted or unsubstituted alkyl group of from 1 to about 6 carbon atoms or a substituted or unsubstituted aryl group of from about 6 to about 10 carbon atoms;

at least another of the magenta dyes having the formula:

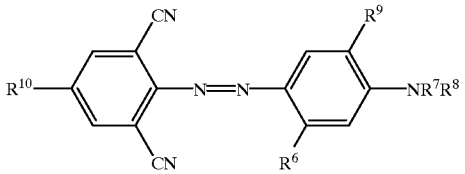

wherein:

$R^6$ is a substituted or unsubstituted alkyl group having from 1 to about 4 carbon atoms, an alkoxy group having from 1 to about 4 carbon atoms, an alkylcarbonamido group having from 1 to about 6 carbon atoms or an alkylsulfonamido group having from 1 to about 8 carbon atoms;

$R^7$ and $R^8$ each individually represent a substituted or unsubstituted aryl group having from about 6 to about 10 carbon atoms, a substituted or unsubstituted alkyl group having from 1 to about 5 carbon atoms, an alkoxyalkyl group having from 3 to about 8 carbon atoms, an aralkyl group having from about 7 to about 10 carbon atoms or a hydroxyalkyl group having from about 2 to about 5 carbon atoms;

$R^9$ is hydrogen, halogen, an alkoxy group having from 1 to about 4 carbon atoms or may be taken together with $R^7$ or $R^8$ to form a 5- or 6-membered heterocyclic ring; and $R^{10}$ is hydrogen, a substituted or unsubstituted alkyl group having from 1 to about 8 carbon atoms or an alkoxy group having from 1 to about 4 carbon atoms;

said yellow dye having the formula:

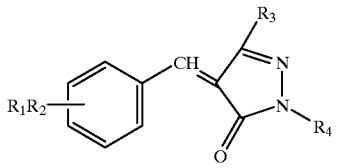

wherein:

$R_1$, $R_2$ and $R_3$ each individually represents hydrogen or a substituted or unsubstituted alkyl or alkoxy group having from 1 to about 4 carbon atoms; and $R_4$ represents a substituted or unsubstituted aryl group having from 6 to about 10 carbon atoms or a substituted or unsubstituted alkyl group having from 1 to about 4 carbon atoms; and said element containing a complexing agent having the formula:

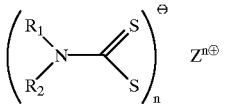

wherein $R_1$ and $R_2$ each independently represents an alkyl group having from 1 to about 6 carbon atoms; a substituted or unsubstituted aryl group having from 6 to about 10 carbon atoms; or a hetaryl group having from about 5 to about 10 atoms; or $R_1$ and $R_2$ may be taken together to form a 5- or 6-membered ring;

Z represents a cation; and n represents 1 or 2.

2. The element of claim 1 wherein said dye-donor element contains an infrared-absorbing dye in said dye layer.

3. The element of claim 1 wherein said complexing agent is present in an amount of from about 2 to about 20% by weight.

4. The element of claim 1 wherein $R_1$ and $R_2$ are taken together to form a piperidine ring, n is 1 and Z is sodium.

5. The element of claim 1 wherein $R_1$ and $R_2$ are each butyl, n is 2 and Z is zinc.

6. A process of forming a dye transfer image comprising imagewise-heating a magenta dye-donor element comprising a support having thereon a dye layer comprising a mixture of magenta dyes and a yellow dye dispersed in a polymeric binder, at least one of the magenta dyes having the formula:

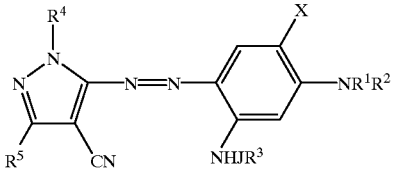

wherein:

$R^1$ is a substituted or unsubstituted alkyl or allyl group of from 1 to about 6 carbon atoms;

X is an alkoxy group of from 1 to about 4 carbon atoms or represents the atoms which when taken together with $R^2$ forms a 5- or 6-membered ring;

$R^2$ is any of the groups for $R^1$ or represents the atoms which when taken together with X forms a 5- or 6-membered ring;

$R^3$ is a substituted or unsubstituted alkyl group of from 1 to about 6 carbon atoms or a substituted or unsubstituted aryl group of from about 6 to about 10 carbon atoms;

J is CO, $CO_2$, —$SO_2$— or $CONR^5$—;

$R^4$ is a substituted or unsubstituted alkyl or allyl group of from 1 to about 6 carbon atoms or a substituted or unsubstituted aryl group of from about 6 to about 10 carbon atoms; and $R^5$ is hydrogen, a substituted or unsubstituted alkyl group of from 1 to about 6 carbon atoms or a substituted or unsubstituted aryl group of from about 6 to about 10 carbon atoms;

at least another of the magenta dyes having the formula:

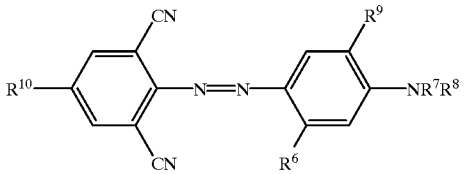

wherein:

$R^6$ is a substituted or unsubstituted alkyl group having from 1 to about 4 carbon atoms, an alkoxy group having from 1 to about 4 carbon atoms, an alkylcarbonamido group having from 1 to about 6 carbon atoms or an alkylsulfonamido group having from 1 to about 8 carbon atoms;

$R^7$ and $R^8$ each individually represent a substituted or unsubstituted aryl group having from about 6 to about 10 carbon atoms, a substituted or unsubstituted alkyl group having from 1 to about 5 carbon atoms, an alkoxyalkyl group having from 3 to about 8 carbon atoms, an aralkyl group having from about 7 to about 10 carbon atoms or a hydroxyalkyl group having from about 2 to about 5 carbon atoms;

$R^9$ is hydrogen, halogen, an alkoxy group having from 1 to about 4 carbon atoms or may be taken together with $R^7$ or $R^8$ to form a 5- or 6-membered heterocyclic ring; and $R^{10}$ is hydrogen, a substituted or unsubstituted alkyl group having from 1 to about 8 carbon atoms or an alkoxy group having from 1 to about 4 carbon atoms;

said yellow dye having the formula:

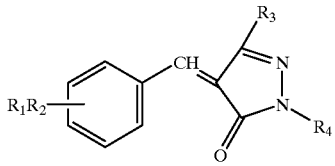

wherein:

$R_1$, $R_2$ and $R_3$ each individually represents hydrogen or a substituted or unsubstituted alkyl or alkoxy group having from 1 to about 4 carbon atoms; and $R_4$ represents a substituted or unsubstituted aryl group having from 6 to about 10 carbon atoms or a substituted or unsubstituted alkyl group having from 1 to about 4 carbon atoms; and said element containing a complexing agent having the formula:

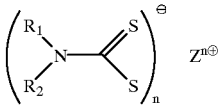

wherein $R_1$ and $R_2$ each independently represents an alkyl group having from 1 to about 6 carbon atoms; a substituted or unsubstituted aryl group having from 6 to about 10 carbon atoms; or a hetaryl group having from about 5 to about 10 atoms; or $R_1$ and $R_2$ may be taken together to form a 5- or 6-membered ring;

Z represents a cation; and n represents 1 or 2.

7. The process of claim 6 wherein said dye-donor element contains an infrared-absorbing dye in said dye layer.

8. The process of claim 6 wherein said complexing agent is present in an amount of from about 2 to about 20% by weight.

9. The process of claim 6 wherein $R_1$ and $R_2$ are taken together to form a piperidine ring, n is 1 and Z is sodium.

10. The process of claim 6 wherein $R_1$ and $R_2$ are each butyl, n is 2 and Z is zinc.

11. A thermal dye transfer assemblage comprising:

a) a magenta dye-donor element comprising a support having thereon a dye layer comprising a mixture of magenta dyes and a yellow dye dispersed in a polymeric binder, and b) a dye-receiving element comprising a support having thereon a dye image-receiving layer, said dye-receiving element being in a superposed relationship with said magenta dye-donor element so that said dye layer is in contact with said dye image-receiving layer, at least one of the magenta dyes having the formula:

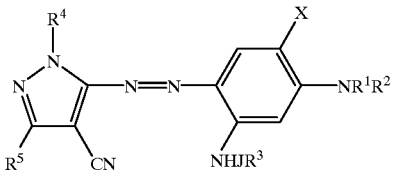

wherein:

$R^1$ is a substituted or unsubstituted alkyl or allyl group of from 1 to about 6 carbon atoms;

X is an alkoxy group of from 1 to about 4 carbon atoms or represents the atoms which when taken together with $R^2$ forms a 5- or 6-membered ring;

$R^2$ is any of the groups for $R^1$ or represents the atoms which when taken together with X forms a 5- or 6-membered ring;

$R^3$ is a substituted or unsubstituted alkyl group of from 1 to about 6 carbon atoms or a substituted or unsubstituted aryl group of from about 6 to about 10 carbon atoms;

J is CO, $CO_2$, —$SO_2$— or $CONR^5$—;

$R^4$ is a substituted or unsubstituted alkyl or allyl group of from 1 to about 6 carbon atoms or a substituted or unsubstituted aryl group of from about 6 to about 10 carbon atoms; and $R^5$ is hydrogen, a substituted or unsubstituted alkyl group of from 1 to about 6 carbon atoms or a substituted or unsubstituted aryl group of from about 6 to about 10 carbon atoms;

at least another of the magenta dyes having the formula:

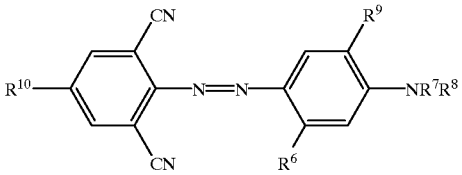

wherein:

$R^6$ is a substituted or unsubstituted alkyl group having from 1 to about 4 carbon atoms, an alkoxy group having from 1 to about 4 carbon atoms, an alkylcarbonamido group having from 1 to about 6 carbon atoms or an alkylsulfonamido group having from 1 to about 8 carbon atoms;

$R^7$ and $R^8$ each individually represent a substituted or unsubstituted aryl group having from about 6 to about 10 carbon atoms, a substituted or unsubstituted alkyl group having from 1 to about 5 carbon atoms, an alkoxyalkyl group having from 3 to about 8 carbon atoms, an aralkyl group having from about 7 to about 10 carbon atoms or a hydroxyalkyl group having from about 2 to about 5 carbon atoms;

$R^9$ is hydrogen, halogen, an alkoxy group having from 1 to about 4 carbon atoms or may be taken together with $R^7$ or $R^8$ to form a 5- or 6-membered heterocyclic ring; and $R^{10}$ is hydrogen, a substituted or unsubstituted alkyl group having from 1 to about 8 carbon atoms or an alkoxy group having from 1 to about 4 carbon atoms;

said yellow dye having the formula:

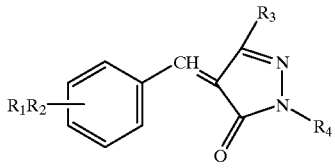

wherein:

$R_1$, $R_2$ and $R_3$ each individually represents hydrogen or a substituted or unsubstituted alkyl or alkoxy group having from 1 to about 4 carbon atoms; and $R_4$ represents a substituted or unsubstituted aryl group having from 6 to about 10 carbon atoms or a substituted or unsubstituted alkyl group having from 1 to about 4 carbon atoms; and said element contains a complexing agent having the formula:

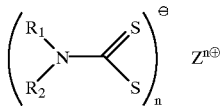

wherein $R_1$ and $R_2$ each independently represents an alkyl group having from 1 to about 6 carbon atoms; a substituted or unsubstituted aryl group having from 6 to about 10 carbon atoms; or a hetaryl group having from about 5 to about 10 atoms; or $R_1$ and $R_2$ may be taken together to form a 5- or 6-membered ring;

Z represents a cation; and n represents 1 or 2.

12. The assemblage of claim 11 wherein said dye-donor element contains an infrared-absorbing dye in said dye layer.

13. The assemblage of claim 11 wherein said complexing agent is present in an amount of from about 2 to about 20% by weight.

14. The assemblage of claim 11 wherein $R_1$ and $R_2$ are taken together to form a piperidine ring, n is 1 and Z is sodium.

15. The assemblage of claim 11 wherein $R_1$ and $R_2$ are each butyl, n is 2 and Z is zinc.

* * * * *